US007291797B2

(12) United States Patent
Yang

(10) Patent No.: US 7,291,797 B2
(45) Date of Patent: Nov. 6, 2007

(54) TUNING STRUCTURE OF A SOUND MIXER

(75) Inventor: Ming-Lung Yang, Hong Kong (CN)

(73) Assignee: Seikaku Technical Group Limited, Hong Kong (CN)

( * ) Notice: Subject to any disclaimer, the term of this patent is extended or adjusted under 35 U.S.C. 154(b) by 57 days.

(21) Appl. No.: 11/374,001

(22) Filed: Mar. 14, 2006

(65) Prior Publication Data

US 2007/0151839 A1 Jul. 5, 2007

(51) Int. Cl.
*H01H 17/02* (2006.01)

(52) U.S. Cl. ..... 200/547; 200/252; 338/160

(58) Field of Classification Search ..... 200/547–549, 200/536, 562, 572, 252, 296; 338/68, 118, 338/198, 160–162
See application file for complete search history.

(56) References Cited

U.S. PATENT DOCUMENTS 3,617,976 A * 11/1971 Campbell ..... 338/133
3,928,838 A * 12/1975 Leppek ..... 338/183
5,844,184 A * 12/1998 Liau ..... 200/16 R
5,864,186 A * 1/1999 Kurtz et al. ..... 307/119
6,262,379 B1 * 7/2001 Tajima ..... 200/5 R
6,483,063 B2 * 11/2002 Chu ..... 200/547
6,841,749 B1 * 1/2005 Radosavljevic et al. .... 200/550

* cited by examiner

*Primary Examiner*—K. Richard Lee
(74) *Attorney, Agent, or Firm*—Browdy and Neimark, PLLC

(57) ABSTRACT

A tuning structure of a sound mixer is disclosed to include a switch set, formed of sliding switches with a respective switching lever, a face panel, which has sliding slots arranged in parallel for the passing of the switching levers of the switch set, a track set, which is mounted in between the switch set and the face panel and has pairs of ribs for guiding movement of the switching levers of the sliding switches stably along the sliding slots of the face panel, and tuning keys respectively fastened to the switching levers of the switch set and suspending above the face panel.

10 Claims, 5 Drawing Sheets

TUNING STRUCTURE OF A SOUND MIXER

BACKGROUND OF THE INVENTION

1. Field of the Invention

The present invention relates to a sound mixer and more specifically, to the tuning structure of a sound mixer.

2. Description of the Related Art

A sound mixer is commonly used in Hi-Fi stereo. A sound mixer generally has a tuning structure. A commercial tuning structure is known having a plurality of sliding switches for tuning. This design of tuning structure is easy to operate. However, when operating the switching lever of one sliding switch, the switching lever may be biased and damaged accidentally. Further, because the sliding switches are exposed to the outer open side, external objects may fall to the inside of the sliding switches accidentally, causing contact failure or damage to the sliding switches.

SUMMARY OF THE INVENTION

The present invention has been accomplished under the circumstances in view. It is the main object of the present invention to provide a tuning structure for sound mixer, which guides the switching levers smoothly against vibration and has means to protect the switch set against external object. It is another object of the present invention to provide a tuning structure for sound mixer, which uses a modularized track set, simplifying the structure.

To achieve these and other objects of the present invention, the tuning structure comprises a switch set, which has a substrate, a plurality of sliding switches mounted on the top side of the substrate and arranged in parallel, and a plurality of switching levers horizontally movable along the sliding switches; a face panel, which has a flat panel body and a plurality of sliding slots cut through the top and bottom sides of the flat panel body for the passing of the switching levers of the switch set; a track set, which is mounted in between the switch set and the face panel, having a plurality of tracks fixedly fastened to the bottom side of the flat panel body of the face panel corresponding to the sliding slots of the face panel, each track having guide means respectively fitted into the sliding slots of the face panel and a longitudinal sliding slot formed in the guide means for the passing of the switching levers of the switch set respectively; and a plurality of tuning keys respectively fastened to the switching levers of the switch set and suspending above the face panel.

DETAILED DESCRIPTION OF THE INVENTION

Figure 1:
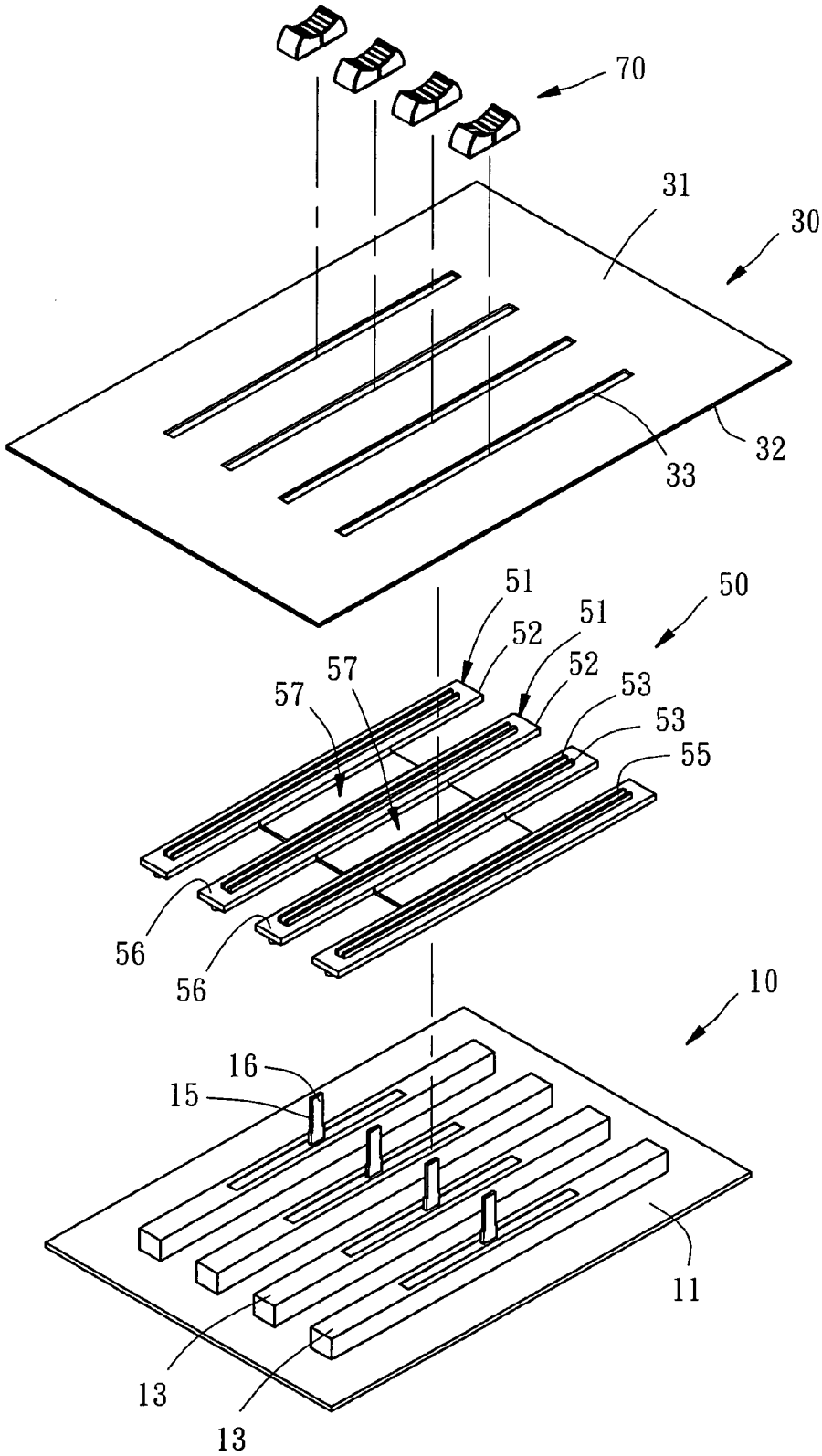
FIG. 1 is an exploded view of a tuning structure for sound mixer in accordance with a first embodiment of the present invention.
Figure 3:
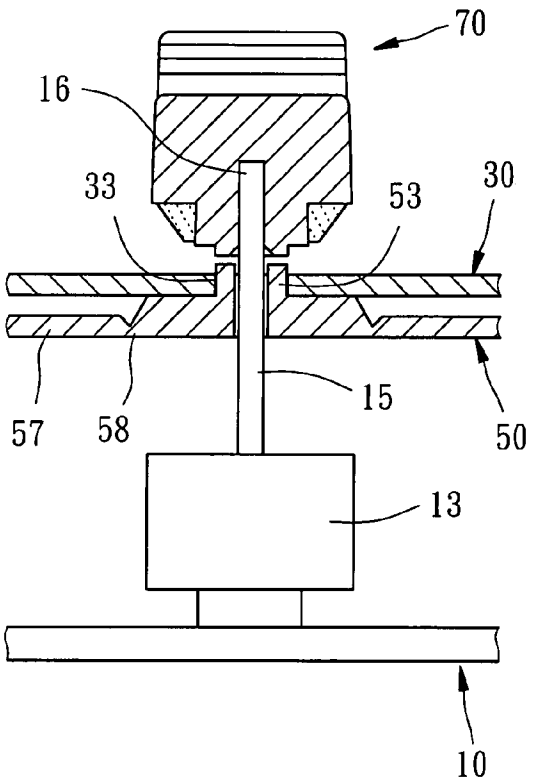
FIG. 3 is a side view in section in an enlarged scale of the tuning structure for sound mixer according to the first embodiment of the present invention.
Figure 2:
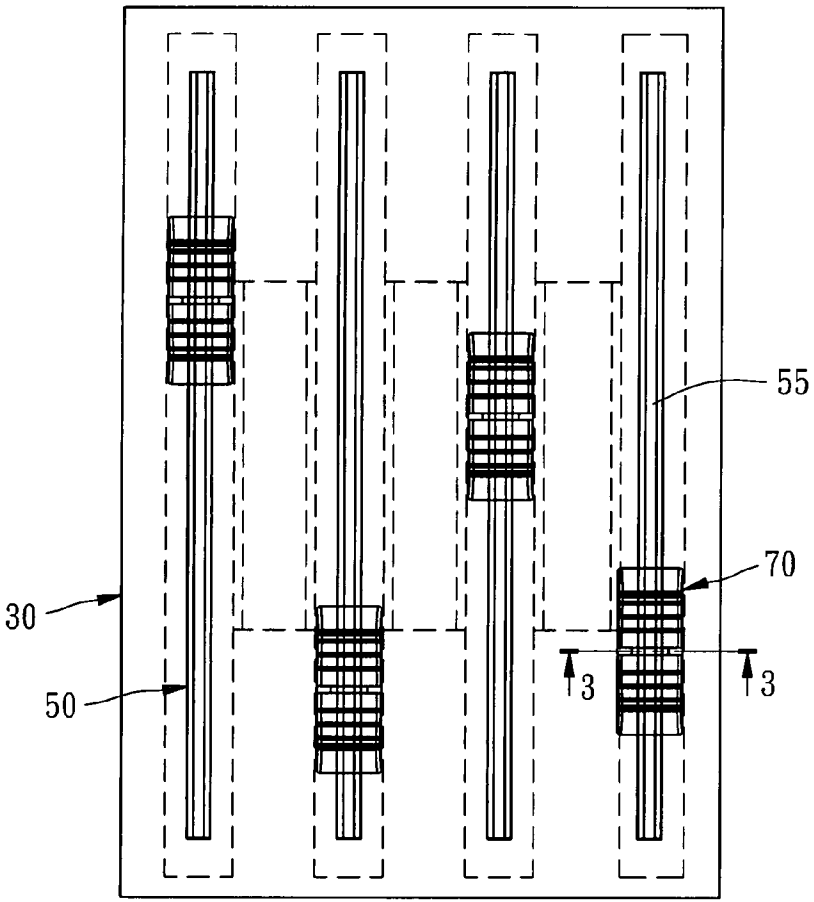
FIG. 2 is a schematic top view of the tuning structure for sound mixer according to the first embodiment of the present invention.

Referring to FIGS. 1~4, a tuning structure in accordance with a first embodiment of the present invention is shown installed in the base of a sound mixer (not shown). The tuning structure is comprised of a switch set 10, a face panel 30, a track set 50, and tuning keys 70.

The switch set 10 has a substrate 11, a plurality of sliding switches 13 mounted on the substrate 11 and arranged in parallel on the top side of the substrate 11 at an equal pitch, and a plurality of switching levers 15 respectively horizontally movable along the sliding switches 13. The sliding switches 13 are electrically connected to, for example, a circuit board (not shown) to provide a respective control function.

The face panel 30 has a flat panel body 31, a bonding surface 32, and a plurality of sliding slots 33 cut through the top and bottom sides of the flat panel body 31 and arranged in parallel corresponding to the sliding switches 13 of the switch set 10.

The track set 50 has a plurality of tracks 51, and a plurality of connecting members 57 each of which is connected between each two adjacent tracks 51 to hold the tracks 51 in parallel. A plurality of breakable portions 58 formed integral between each adjacent track 51 and connecting member 57. The breakable portions 58 can easily be broken to separate the tracks 51 from one another. Each track 51 has a flat elongated rail 52, guide means, for example, two longitudinal ribs 53 arranged in parallel on the rail 52 and extending in direction along the length of the rail 52, a longitudinal sliding slot 55 cut through the top and bottom sides of the rail 52 between the longitudinal ribs 53, a bonding surface 56 formed on the border area of the longitudinal ribs 53 and bonded to the bonding surface 32 of the face panel 30. After bonding of the track set 50 to the face panel 30, the longitudinal sliding slots 55 of the tracks 51 of the track set 50 are respectively aimed at the sliding slots 33 of the face panel 30, and the switching levers 15 of the sliding switches 13 of the switch set 10 are respectively inserted through the longitudinal sliding slots 55 of the tracks 51 of the track set 50 and the sliding slots 33 of the face panel 30 and respectively supported between the longitudinal ribs 53 of each of the tracks 51 of the track set 50.

The tuning keys 70 each have a key body 71, a key cap 72 capped on the key body 71, a receptacle 73 downwardly suspending from the bottom side of the key body 71 for receiving the top mounting portion 16 of the switching lever 15 of one sliding switch 13 of the switch set 10, and two retaining ribs 75 disposed at two sides of the receptacle 73 for clamping the two opposite lateral sides of the top mounting portion 16 of the switching lever 15.

The operation of the present invention is outlined hereinafter. When operating one sliding switch 13 of the switch set 10, the longitudinal ribs 53 of the associating track 51 guide the movement of the sliding switch 13 smoothly in course and prohibit the sliding switch 13 from vibration or sideway displacement, preventing damage of the structure of the sliding switch 13.

Figure 5:
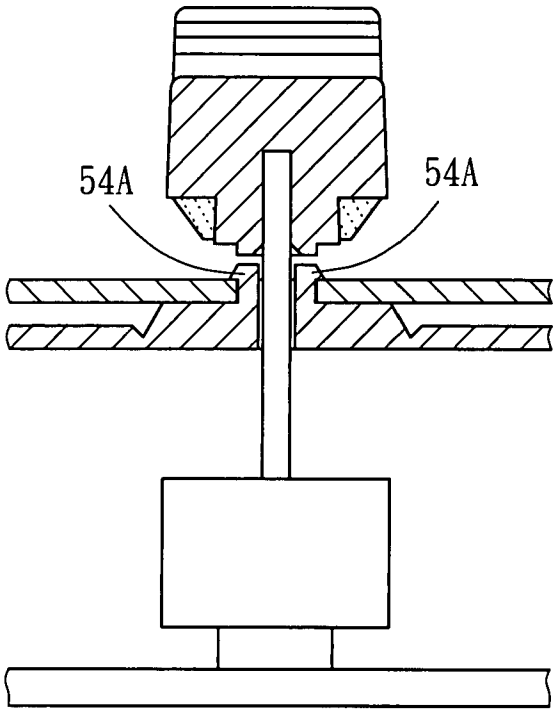
FIG. 5 is a side view in section of a tuning structure for sound mixer in accordance with a second embodiment of the present invention.
Figure 4:
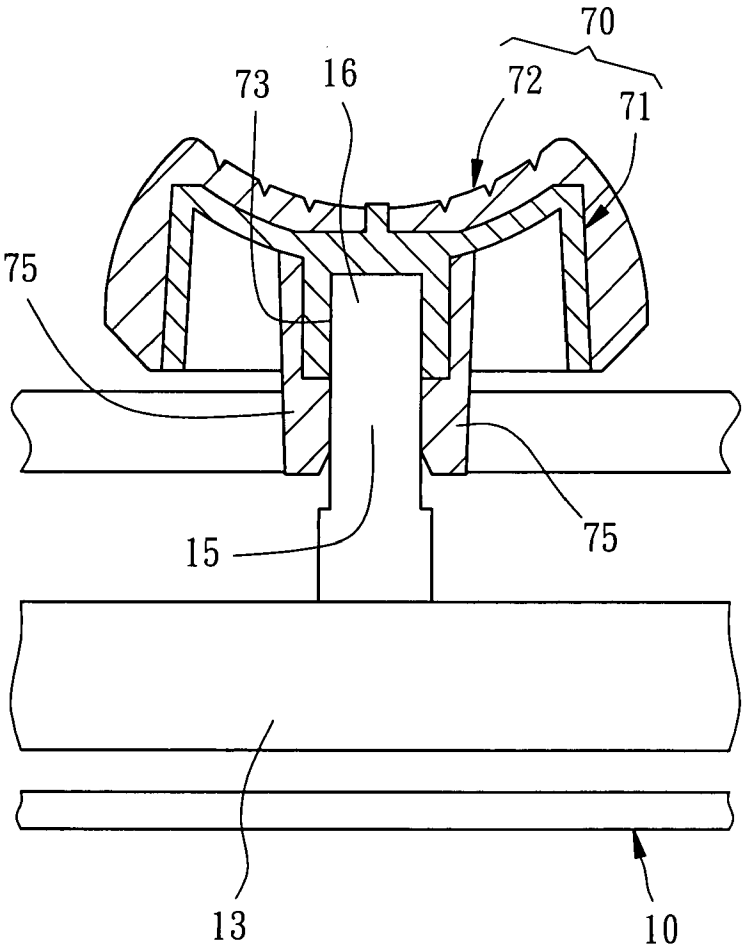
FIG. 4 is a front view in section in an enlarged scale of the tuning structure for sound mixer according to the first embodiment of the present invention.

FIG. 5 shows a part of a tuning structure for sound mixer in accordance with a second embodiment of the present invention. This embodiment is substantially similar to the aforesaid first embodiment with the exception that each rib of the rail of each track of the track set has a retaining lip 54A for engaging into a respective locating groove on the face panel. By means of engaging the retaining lips 54A of the track set into the respective locating grooves on the face panel, the track set and the face panel are fastened together without glue.

Figure 6:
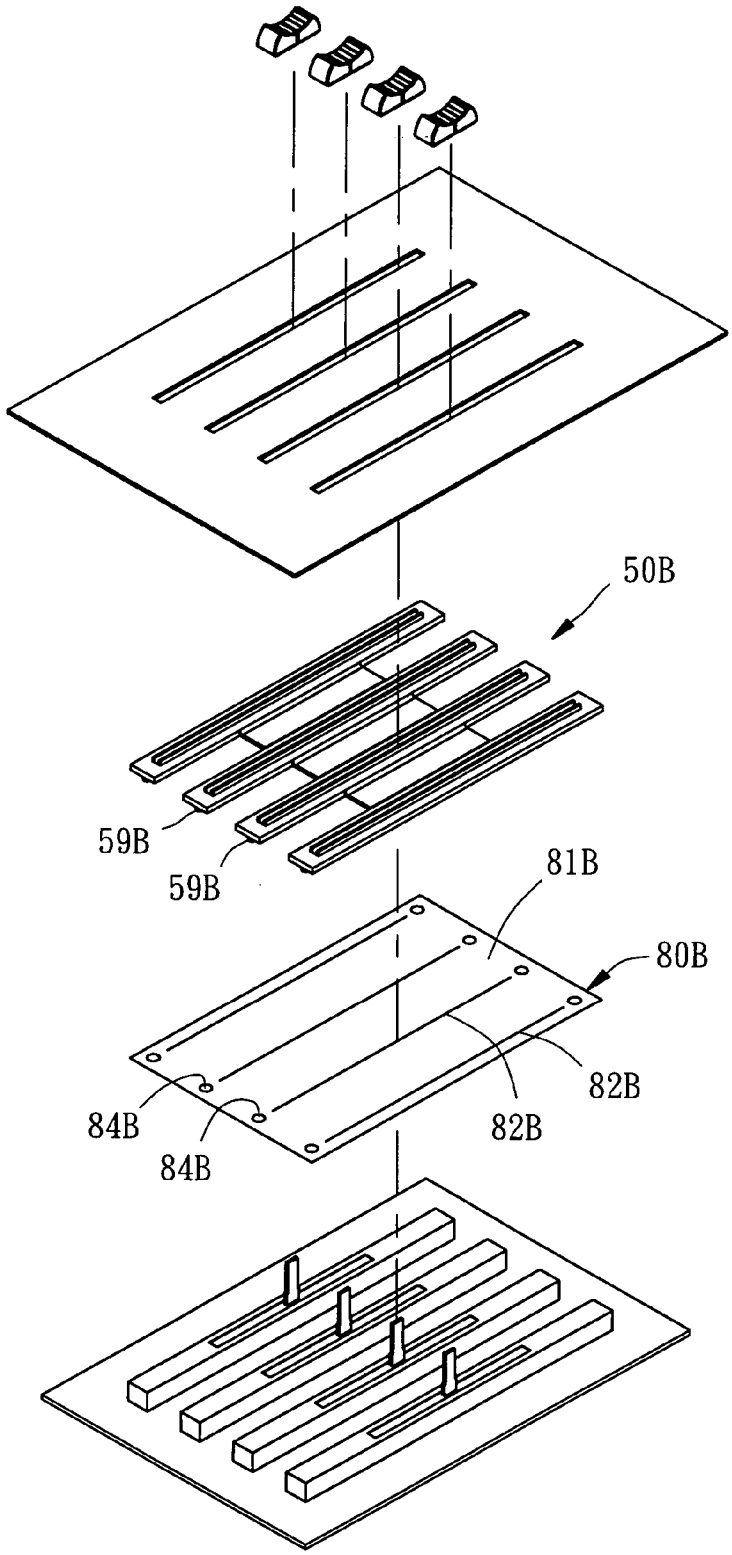
FIG. 6 is an exploded view of a tuning structure for sound mixer in accordance with a third embodiment of the present invention.
Figure 7:
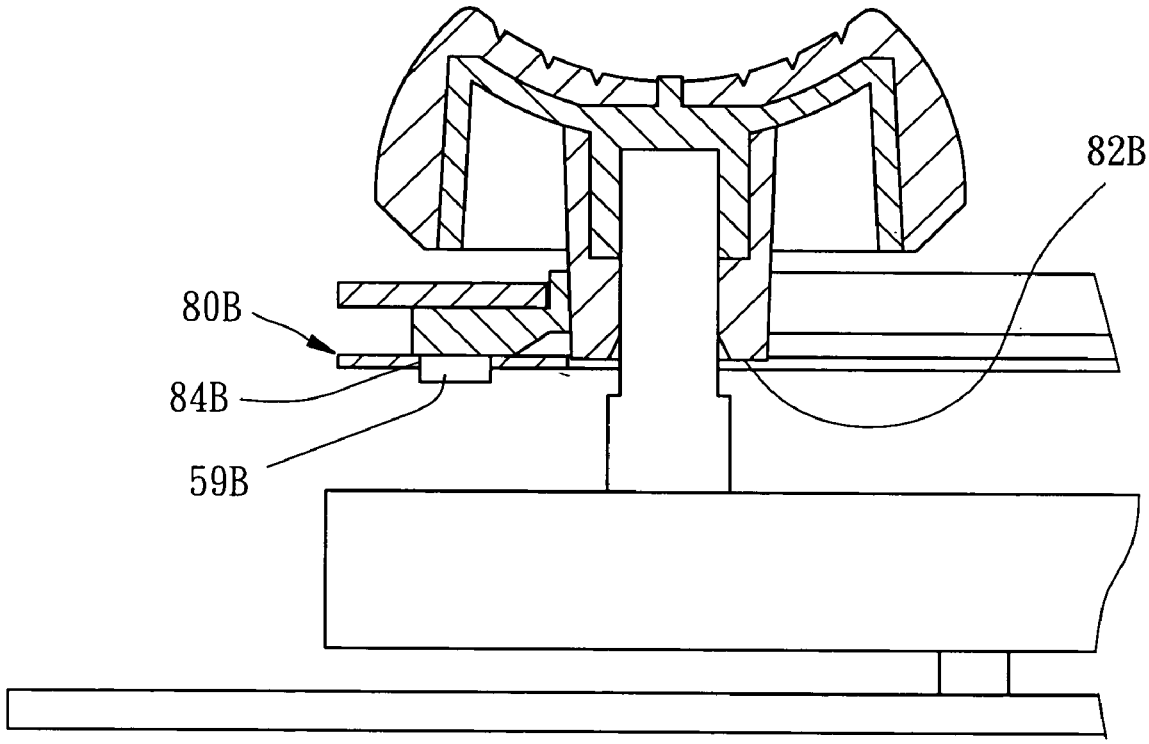
FIG. 7 is a sectional view in an enlarged scale of a part of FIG. 6.

FIGS. 6 and 7 show a tuning structure for sound mixer in accordance with a third embodiment of the present invention. This embodiment is substantially similar to the aforesaid first embodiment with the exception of that the turning structure of this third embodiment further comprises a spacer member 80B. The spacer member 80B is formed of a fabric member having a thin body 81B, a plurality of narrow elongated crevices 82B cut through the top and bottom sides of the thin body 81B and arranged in parallel corresponding to the longitudinal sliding slots of the tracks of the track set 50B, and a plurality of mounting holes 84B cut through the top and bottom sides of the thin body 81B. The track set 50B has a plurality of bottom mounting portions 59B downwardly protruding from the bottom side thereof and respectively inserted into the mounting holes 84B of the spacer member 80B to secure the spacer member 80B in place.

When moving the switching lever of one sliding switch of the switch set to a particular position in the associating sliding slot of the track set 50B, the spacer member 80B block the other part of the sliding slot. Therefore, the spacer member 80B block the sliding slots of the track set 50B, preventing falling of external objects to the inside of the switch set accidentally that may cause the sliding switches to be covered with rust and jammed.

As indicated above, the tuning structure of the present invention uses the ribs on the rail of each track to prohibit vibration of the associating switching lever during turning operation, preventing damage of the sliding switches of the switch set. Further, a spacer member is provided to block the longitudinal sliding slots of the tracks of the track set against external objects without interfering with normal operation of the sliding switches of the switch set.

What is claimed is:

1. A tuning structure used in a sound mixer, comprising:

a switch set, said switch set having a substrate, a plurality of sliding switches mounted on a top side of said substrate and arranged in parallel, and a plurality of switching levers horizontally movable along said sliding switches;

a face panel, said face panel having a flat panel body and a plurality of sliding slots cut through top and bottom sides of said flat panel body for the passing of said switching levers of said switch set;

a track set mounted in between said switch set and said face panel, said track set having a plurality of tracks fixedly fastened to the bottom side of said flat panel body of said face panel corresponding to the sliding slots of said face panel, said tracks each having guide means respectively fitted into the sliding slots of said face panel and a longitudinal sliding slot formed in said guide means for the passing of said switching levers of said switch set respectively; and a plurality of tuning keys respectively fastened to said switching levers of said switch set and suspending above said face panel.

2. The tuning structure as claimed in claim 1, wherein the guide means of each of said tracks of said track set has two longitudinal ribs arranged in parallel, and the longitudinal sliding slot of each of said tracks of said track set is defined between the two longitudinal ribs of the respective track.

3. The tuning structure as claimed in claim 2, wherein said the longitudinal ribs of said tracks of said track set are respectively inserted into the sliding slots of said face panel.

4. The tuning structure as claimed in claim 3, wherein said the longitudinal ribs of said tracks of said track set each have a retaining lip engaged into a respective locating groove on said face panel to secure said track set to said face panel.

5. The tuning structure as claimed in claim 1, wherein said tracks of said track set each have a bonding surface respectively bonded to said face panel.

6. The tuning structure as claimed in claim 1, wherein said track set further has a connecting member connected between each two adjacent tracks to join said tracks.

7. The tuning structure as claimed in claim 6, wherein said connecting member has a plurality of breakable portions formed integral between each adjacent track and connecting member.

8. The tuning structure as claimed in claim 1, wherein said tuning caps each have two retaining ribs respectively clamped on two sides of the associating switching lever.

9. The tuning structure as claimed in claim 1, wherein said tuning caps each have at least one rib inserted into the associating sliding slot of said face panel and the associating sliding slot of said track set.

10. The tuning structure as claimed in claim 1, further comprising a spacer member mounted in between said track set and said switch set for blocking the sliding slots of said track set against external objects, said spacer member having a plurality of narrow elongated crevices for the passing of said switching levers.

* * * * *